US010527301B2

(12) United States Patent
Schock

(10) Patent No.: US 10,527,301 B2
(45) Date of Patent: Jan. 7, 2020

(54) PORTABLE MISTING FAN AND ATTACHMENT MECHANISM

(71) Applicant: James R. Schock, Park City, UT (US)

(72) Inventor: James R. Schock, Park City, UT (US)

( * ) Notice: Subject to any disclaimer, the term of this patent is extended or adjusted under 35 U.S.C. 154(b) by 283 days.

(21) Appl. No.: 15/825,066

(22) Filed: Nov. 28, 2017

(65) Prior Publication Data

US 2018/0149378 A1 May 31, 2018

Related U.S. Application Data

(60) Provisional application No. 62/427,065, filed on Nov. 28, 2016.

(51) Int. Cl.

| | |
|---|---|
| ***F24F 5/00*** | (2006.01) |
| ***F24F 7/007*** | (2006.01) |
| ***F04D 25/10*** | (2006.01) |
| ***F04D 29/70*** | (2006.01) |
| ***F24F 13/20*** | (2006.01) |
| ***F04D 19/00*** | (2006.01) |
| ***F24F 6/16*** | (2006.01) |

(52) U.S. Cl.

CPC ..... *F24F 5/0035* (2013.01); *F04D 19/002* (2013.01); *F04D 25/10* (2013.01); *F04D 29/705* (2013.01); *F24F 6/16* (2013.01); *F24F 7/007* (2013.01); *F24F 13/20* (2013.01); *F24F 2221/12* (2013.01)

(58) Field of Classification Search

CPC .. F24F 5/00; F24F 5/0035; F24F 13/20; F24F 6/14; F24F 6/16; F24F 7/007; F24F 2221/12; F04D 25/08; F04D 25/088; F04D 25/06; F04D 25/10; F04D 25/105; F04D 19/002

See application file for complete search history.

(56) References Cited

U.S. PATENT DOCUMENTS

2015/0247644 A1* 9/2015 Stearns ..... F24F 6/14 261/37

* cited by examiner

*Primary Examiner* — Richard A Edgar
*Assistant Examiner* — Maxime M Adjagbe
(74) *Attorney, Agent, or Firm* — Terrence J. Edwards; TechLaw Ventures, PLLC

(57) ABSTRACT

The disclosure extends to methods, systems, and devices for providing a portable fan misting system that may spray a fine fluid mist. The system comprises a fan, a receptacle for holding a liquid, and an attachment component attached to the fan. The attachment component includes a wall comprising an interior surface and an exterior surface, and an interior space defined by the wall. The attachment component includes a first connection component formed as part of the wall for supporting the fan in an upright, active configuration and connection the fan to a receptacle in the upright, active configuration. The attachment component includes a second connection component formed as part of the wall for supporting the fan in a storage, non-active configuration and connecting the fan to the receptacle, such that the fan is stored within the receptacle in the storage, non-active configuration.

23 Claims, 14 Drawing Sheets

PORTABLE MISTING FAN AND ATTACHMENT MECHANISM

CROSS-REFERENCE TO RELATED APPLICATIONS

This application claims the benefit of U.S. Provisional Patent Application No. 62/427,065 filed on Nov. 28, 2016, which is incorporated by reference herein in its entirety, including but not limited to those portions that specifically appear hereinafter, the incorporation by reference being made with the following exception: In the event that any portion of the above-referenced application is inconsistent with this application, this application supersedes said above-referenced application.

FEDERALLY SPONSORED RESEARCH DEVELOPMENT

Not applicable.

BACKGROUND

The disclosure relates generally to methods, systems, and devices for a portable fan misting system. The disclosure relates to a portable fan misting system that may receive fluid from a fluid receptacle or a constant fluid source, and that may provide a fluid mist to a user.

A variety of machines have been developed, described and are widely known for providing a fluid mist, and particularly a water mist, to a user. A fluid mist may be desirable in hot weather where a user wishes to feel more comfortable or cool down. Such fluid misting devices may include a nozzle configured to spray a light degree of fluid at a light pressure that is comfortable to a user. Such devices may be connected to a stable water source, such as a garden hose, or may use a receptacle. However, there are several problems with the currently available misting systems including, inter alia, many portable fan misting systems are inadequate to provide the comfort level desired, have inadequate power supplies for portability, are bulky and not easily carried or are otherwise not easily portable to name a few.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all these matters form part of the prior art base, or were common general knowledge in the field relevant to the disclosure as it existed before the priority date of each claim of this disclosure.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

Figure 1:
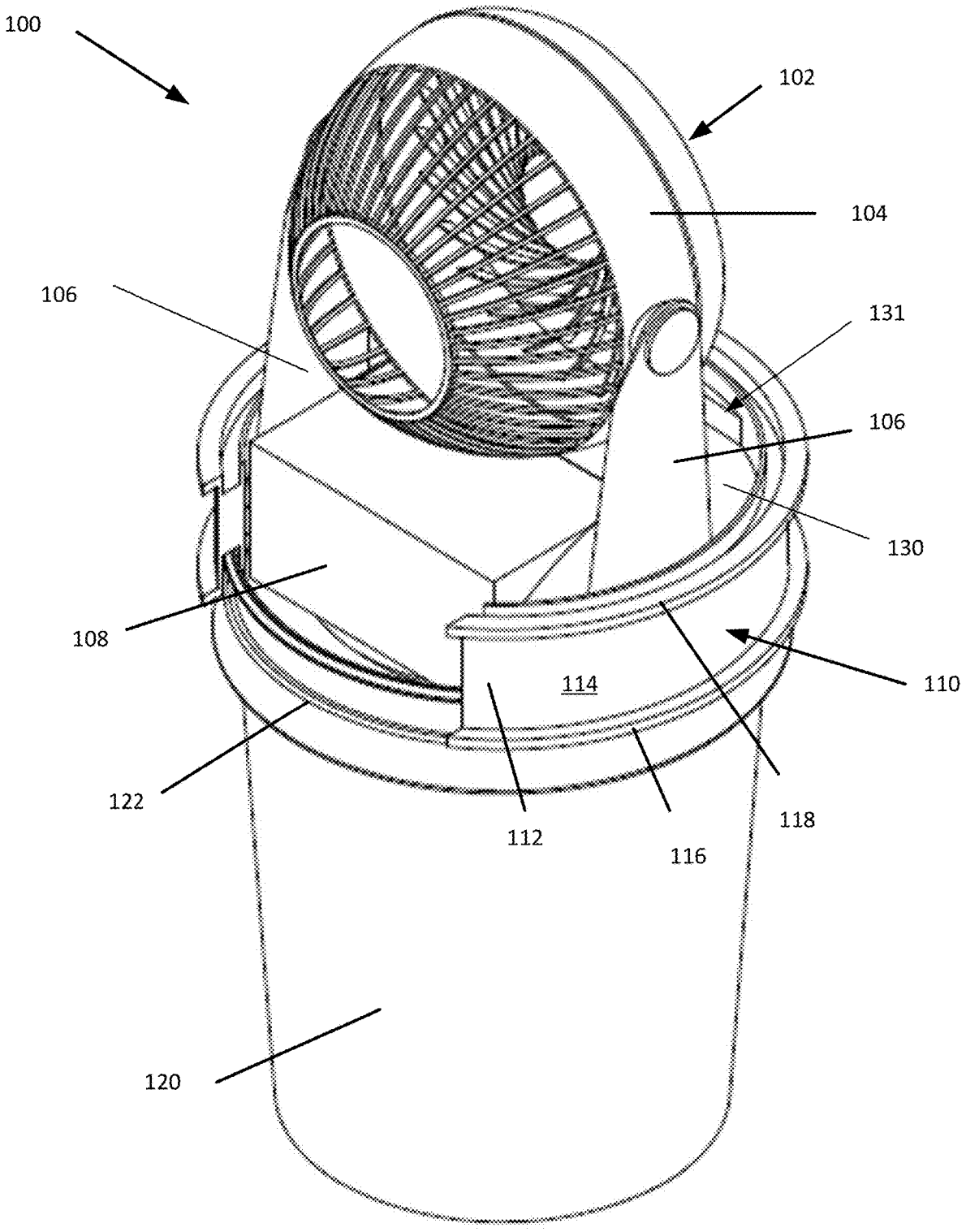
FIG. 1 illustrates a rear perspective view of an embodiment of a portable misting fan in accordance with the teachings and principles of the disclosure.

The disclosure extends to methods, systems, and devices for providing a portable misting fan for spraying a fluid mist and running a fan. In the following description of the disclosure, reference is made to the accompanying drawings, which form a part hereof, and in which is shown by way of illustration specific implementations in which the disclosure may be practiced. It is understood that other implementations may be utilized and structural changes may be made without departing from the scope of the disclosure.

Before the methods, systems and devices for providing a portable misting fan system are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

In warm environments it is common for persons to employ a fluid misting system to cool down an area surrounding the misting system or to cool down a person in the uncomfortably warm environment. Many such misting systems are not portable and require a constant water source to function. Other portable fan misting systems may include a small fluid receptacle and may not be capable of providing a fluid mist for an extended period of time. Further, other portable fan misting systems are cumbersome and do not allow a user to store system components or safely transport the system with stored fluid. Accordingly, a portable misting fan system that can be safely and securely transported with stored fluid, that may be compactly stored, and that may provide a fluid mist for an extended period of time is desirable.

A variety of machines have been developed, described, and are widely known for providing a fan and/or misting system. Such devices are often bulky, heavy, and exceedingly cumbersome, even when intended to be deployed as a portable system. Some systems known in the art require a user to separately carry multiple components to an event or location to enjoy the use of the fan and misting system. As such, users may be required to make multiple trips to carry a single unit or to carry multiple units to a location.

Accordingly, systems, methods, and devices for providing a convenient portable fan misting system is desirable. In addition, a system and method for providing a fan misting system that may be conveniently carried by a single user is desirable. In addition, a system and method for providing a fan misting system that may be stored in a corresponding receptacle may simplify the transport and ease-of-use of a portable fan misting system.

In an embodiment, an apparatus includes a fan, a misting nozzle, a receptacle for holding a liquid, and an attachment component configured to attach the fan to the receptacle. The apparatus includes a pump disposed in the attachment component; the pump is configured to draw a liquid out of the receptacle and dispense the liquid through the misting nozzle. The apparatus includes one or more batteries or other power devices disposed in the attachment component; the one or more batteries are configured to provide power to at least the fan and the pump. The fan is secured to the attachment component by way of at least one support. The attachment component may rest on the receptacle in an upright configuration wherein the fan is sitting atop the receptacle. The attachment component may rest on the receptacle in a storage configuration wherein the fan, battery, and pump are stored inside the receptacle. The attachment component, along with the fan, battery, and pump may be sized appropriately such that a receptacle handle may freely move above the attachment component in the storage configuration. In an embodiment, the attachment component is suitable for use with a standard five-gallon bucket.

In an embodiment, an apparatus includes a fan, an attachment component, a pump, and a battery in a single unit. The attachment component is configured to connect the fan to a receptacle in a plurality of orientations. The attachment component is configured to connect the fan to a receptacle in an upright, active configuration wherein the fan is located above the receptacle. The attachment component is configured to connect the fan to the receptacle in a storage, non-active configuration wherein the fan is stored within the receptacle.

In an embodiment, the attachment component includes a wall, further including a first connection component and a second connection component. The first connection component is configured to connect the fan to a receptacle in the upright, active configuration. The second connection component is configured to connect the fan to the receptacle in the storage, non-active configuration. The first connection component is formed within the wall and may include a channel formed within the wall and a flange extending from an external surface of the wall. The second connection component is formed within the wall and may include a channel formed within the wall and a flange extending from the external surface of the wall. In an embodiment, the channel is configured to connect with an upper edge of the receptacle. In an embodiment, the channel is formed by the wall and comprises a sufficient height to provide stability when the fan is connected to the receptacle.

In an embodiment, the channel of the storage connection component is formed within the wall and the channel comprises a height sufficient to permit a receptacle handle to move freely above the attachment component in a storage, non-active configuration. In such an embodiment, the attachment component may further include a base having an interior surface located in a direction facing the fan and an exterior surface located in a direction facing away from the fan. In the storage, non-active configuration, the exterior surface of the base may face upwards relative to the receptacle, and the receptacle handle may pass freely over the exterior surface of the base of the attachment component.

In an embodiment, a pump is disposed within an interior space of the attachment component. The pump is in fluid communication with the liquid reservoir disposed in the receptacle and is in further fluid communication with the misting nozzle. The pump is configured to create a negative pressure to draw the liquid out of the receptacle and further configured to create a positive pressure to dispel the liquid through the misting nozzle.

Referring to the figures, FIG. 1 is a rear perspective view of an embodiment of a portable fan misting system 100. The system 100 includes a fan 102 having an outer casing 104 and at least one support 106. The system 100 includes an attachment component 110 including a wall 112 having an exterior surface 114 and interior surface 113 (not shown in FIG. 1). The attachment component 110 includes an interior space 131 defined by the wall 112 where internal components 108 such as a battery, pump, and the like may be stored in the interior space. The attachment component 110 includes a base 130 attached to the wall 112. The base includes an interior surface oriented in a direction facing the fan 102. The base 130 includes an exterior surface oriented in a direction facing away from the fan 102. The attachment component includes a first connection component 116 and a second connection component 118. The first connection component 116 may alternatively be referred to as the upright connection component 116. The second connection component 118 may alternatively be referred to as the storage connection component 118.

The fan 102 may include a plurality of fan blades for pushing air through the fan 102. It should be appreciated the fan 102 may be powered by any suitable means known in the art, including battery powered, A/C powered, solar powered, and the like. In an embodiment, the fan 102 is battery powered and the battery is housed with the internal component 108 in an interior space defined by the wall 112. It should be appreciated that any suitable fan known in the art may be used. In an embodiment, the fan 102 is sized such that it may be stored inside the receptacle 120. In an embodiment, the fan includes a width or a diameter, and the width or diameter is sufficiently sized to fit inside the receptacle 120. In an embodiment, the width or diameter is sufficiently sized such that the fan 102 could fit within the interior space 131 of the attachment component 110.

The fan support 106 may include one or more supports for holding the fan and securing the fan to the attachment component 110. In an embodiment as pictured in FIG. 1, the fan support 106 includes two corresponding support 106 on either side of the fan 102. In an embodiment, the fan support 106 is attached to a fan casing 104 on an exterior surface of the fan 102. In an embodiment, the fan support 106 is attached to an interior surface of the attachment component 110. In an embodiment, a misting nozzle 1228 (see 1228) is attached to the fan support 106. It should be appreciated that the misting nozzle 1228 may be in fluid communication with a tubing, a pump, and the receptacle 120. In an embodiment, a tubing is attached to a side of the fan support 106 and the tubing is connected to the misting nozzle 1228.

The internal components 108 include any components necessary for operating the system 100. Components 108 include, for example, a pump, a battery, a tubing connection, and so forth. As shown in FIG. 1, the components 108 may be stored in an interior space as defined by the wall 112 of the attachment component 110.

The attachment component 110 is configured to attach the fan 102 to the receptacle 120. In an embodiment, the attachment component latches on to the receptacle 120. In a further embodiment, the attachment component 110 attaches the fan 102 to the receptacle 120 with gravity by resting on a portion of the receptacle 120. It should be appreciated the attachment component may be removably attached to the receptacle by any suitable means known in the art, including for example, a latch, gravity, a flange corresponding with the receptacle 120, a screw mechanism, a pressure mechanism, and so forth.

The attachment component 110 includes a wall 112 having an exterior surface 114 and an interior surface 113 (not shown in FIG. 1). In an embodiment, the shape of the wall 112 corresponds with a shape of the receptacle 120. In an embodiment, the wall 112 forms a complete circle corresponding with a top of the receptacle 120. In an embodiment as shown in FIG. 1, the wall 112 includes a first end and a second end opposing the first end, wherein a gap is formed between the first end and the second end of the wall 112 such that the wall 112 comprises an incomplete elliptical shape. Such an embodiment may be desirable where a user wishes to slide an internal component 108 into the interior space 131 defined by the wall.

The attachment component 110 includes an upright connection component 116 and a storage connection component 118. The upright connection component 116 is configured to connect the fan 102 to the receptacle 120 in an upright, active configuration as shown. An upright, active configuration is defined by the fan 102 being located above the receptacle 120. The storage connection component 118 is configured to attach the fan 102 to the receptacle 120 in a storage, non-active configuration. A storage, non-active configuration is defined by the fan 102 being stored inside the receptacle 120. It should be appreciated that the attachment component 110 may attach the fan 102 to the receptacle 120 by any means known in the art, including means utilizing gravity and the mass of the fan 102 and internal components 108 for stabilizing the fan 102 on top of or inside of the receptacle 120. In an embodiment, the upright connection component 116 and the storage connection component 118 are configured to connect with an upper edge of the receptacle 120. In an embodiment, the upright connection component 116 and the storage connection component 118 are configured to match up with a flange 112 disposed about an exterior surface of the receptacle 120.

Figure 2:
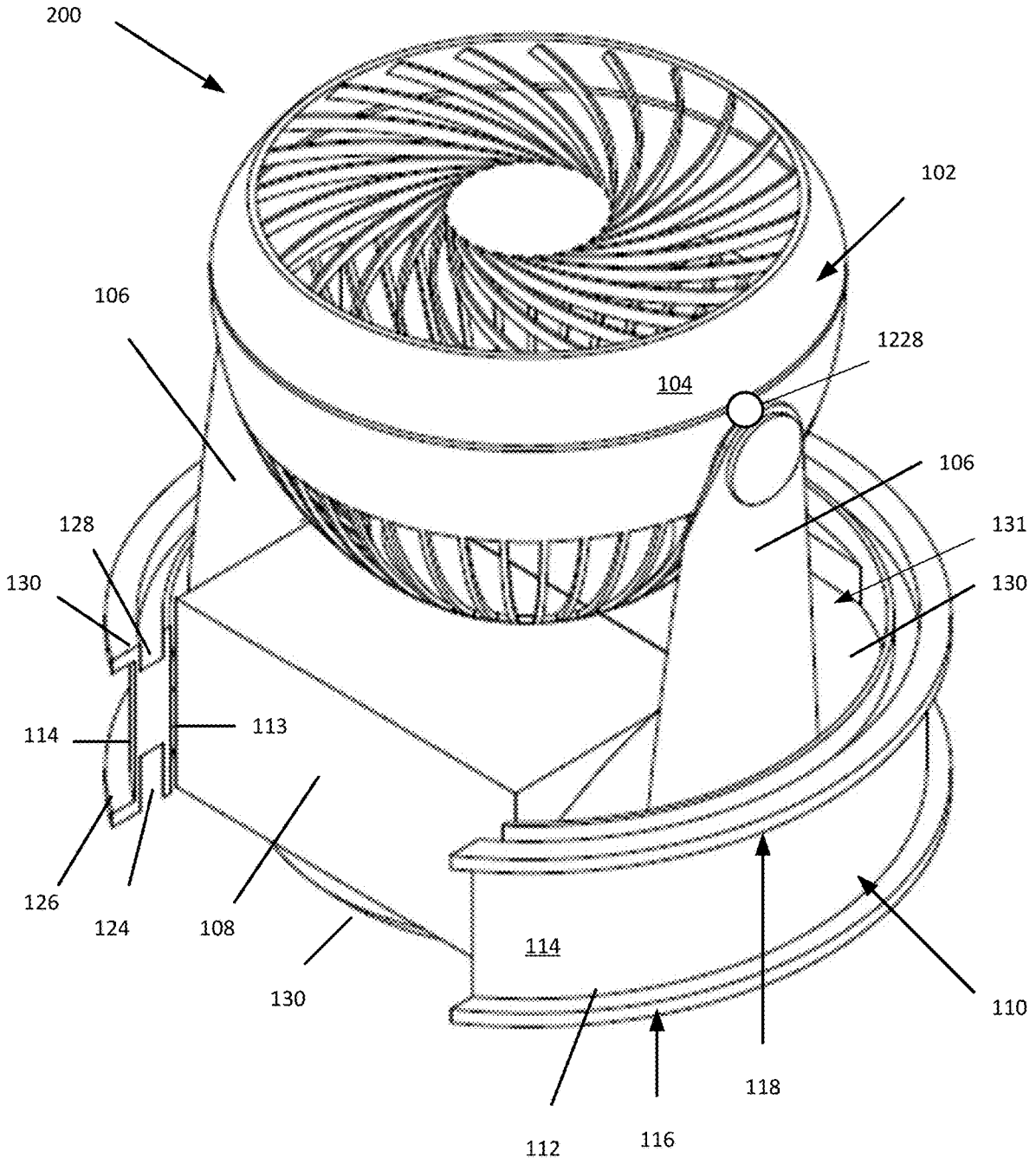
FIG. 2 illustrates a rear perspective view of an embodiment of a portable misting fan in accordance with the teachings and principles of the disclosure.

FIG. 2 illustrates a rear perspective view of a misting fan and attachment component system 200. The system 200 includes a fan 102 having an exterior casing 104 and at least one fan support 106. As disclosed in FIG. 2, the system 200 may include two corresponding fan supports 106 located on either side of the fan 102 and attached to the fan exterior casing 104. In an embodiment, the fan support 106 is secured to an interior surface 113 of the attachment component 110, as shown in FIG. 2. The fan support 106 may comprise a predominantly flat shape such that the fan support 106 does not comprise a great deal of space within the area of the attachment component 110.

In an embodiment as illustrated in FIG. 2, the attachment component 110 may form a circular or elliptical shape and may comprise a cutout such that the attachment component 110 does not comprise a complete circle or ellipse. Such an embodiment may be appreciated where a user wishes to change out one or more components 108 stored within an interior space 131 formed by the attachment component 110. A user may, for example, change out a battery component 108 with ease where the attachment component wall 112 comprises a cutout. In an embodiment as shown in FIG. 2, the cutout may extend a length of the components body 108.

The upright connection component 116 may be located at a bottom portion of the attachment component 110 where the fan 102 denotes the top of the system 200. In an embodiment as illustrated in FIG. 2, the upright connection component 116 includes a channel 124 disposed in the attachment component 110 and a flange 126 extending outward from the attachment component 110. The channel 116 is configured to rest on an upper edge 123 of a receptacle 120. The flange 126 is configured to provide stability by resting on a corresponding flange (see 122) disposed about an exterior surface of the receptacle 120. In an embodiment, the channel 124 is formed in the wall 112 of the attachment component 110.

The storage connection component 118 may be located at a top portion of the attachment component 110 where the fan 102 denotes the top of the system 200. In an embodiment as illustrated in FIG. 2, the storage connection component 118 includes a storage channel 128 disposed in the attachment component 110 and a storage flange 130 extending outward from the attachment component 110. The storage channel 128 is configured to rest on an upper edge 123 of a receptacle 120. The storage flange 130 is configured to provide stability in a storage configuration by resting on a corresponding flange (see 122) disposed about an exterior surface of the receptacle 120. In an embodiment, the channel 128 is formed in a wall 112 of the attachment component 110.

The attachment component 110 includes an exterior surface 114 and an interior surface 113. In an embodiment, the attachment component 110 includes a base 130 located at a bottom of the attachment component 110 in an upright configuration where the fan 102 denotes the top of the system 200. The base 130 may provide a means for securing or resting the component 108 in an interior space 131 defined by the wall 112 of the attachment component 110.

Figure 3:
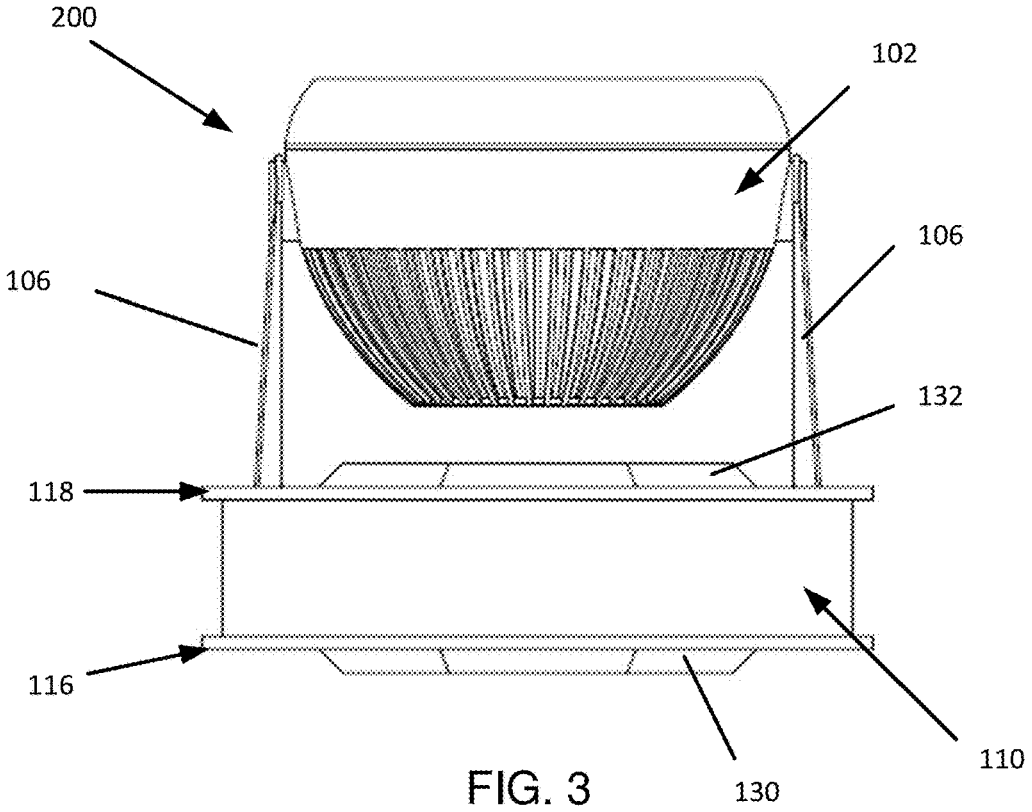
FIG. 3 illustrates a front view of an embodiment of a portable misting fan in accordance with the teachings and principles of the disclosure.
Figure 4:
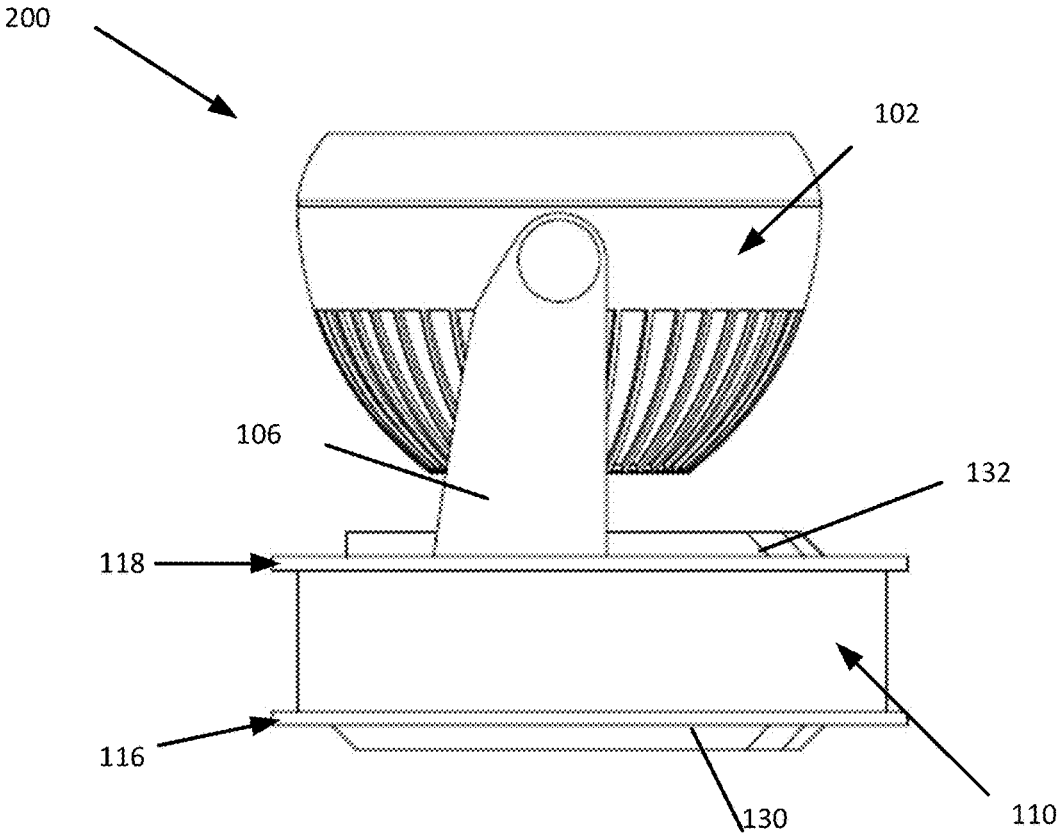
FIG. 4 illustrates a side view of an embodiment of a portable misting fan in accordance with the teachings and principles of the disclosure.

FIGS. 3-4 illustrates various side views of a misting fan and attachment component system 200. The system 200 includes a fan 102 and an attachment component 110. The fan includes at least one fan support 106 secured to an exterior casing of the fan 102 and further secured to the attachment component 110. The attachment component 110 includes an upright connection component 116 and a storage connection component 118. The attachment component 110 includes a base 130 and a lid 132. In an embodiment, the base 130 and the lid 132 are configured to provide protection and a water seal to components 108 stored within an interior space 131 of the attachment component 110.

Figure 5:
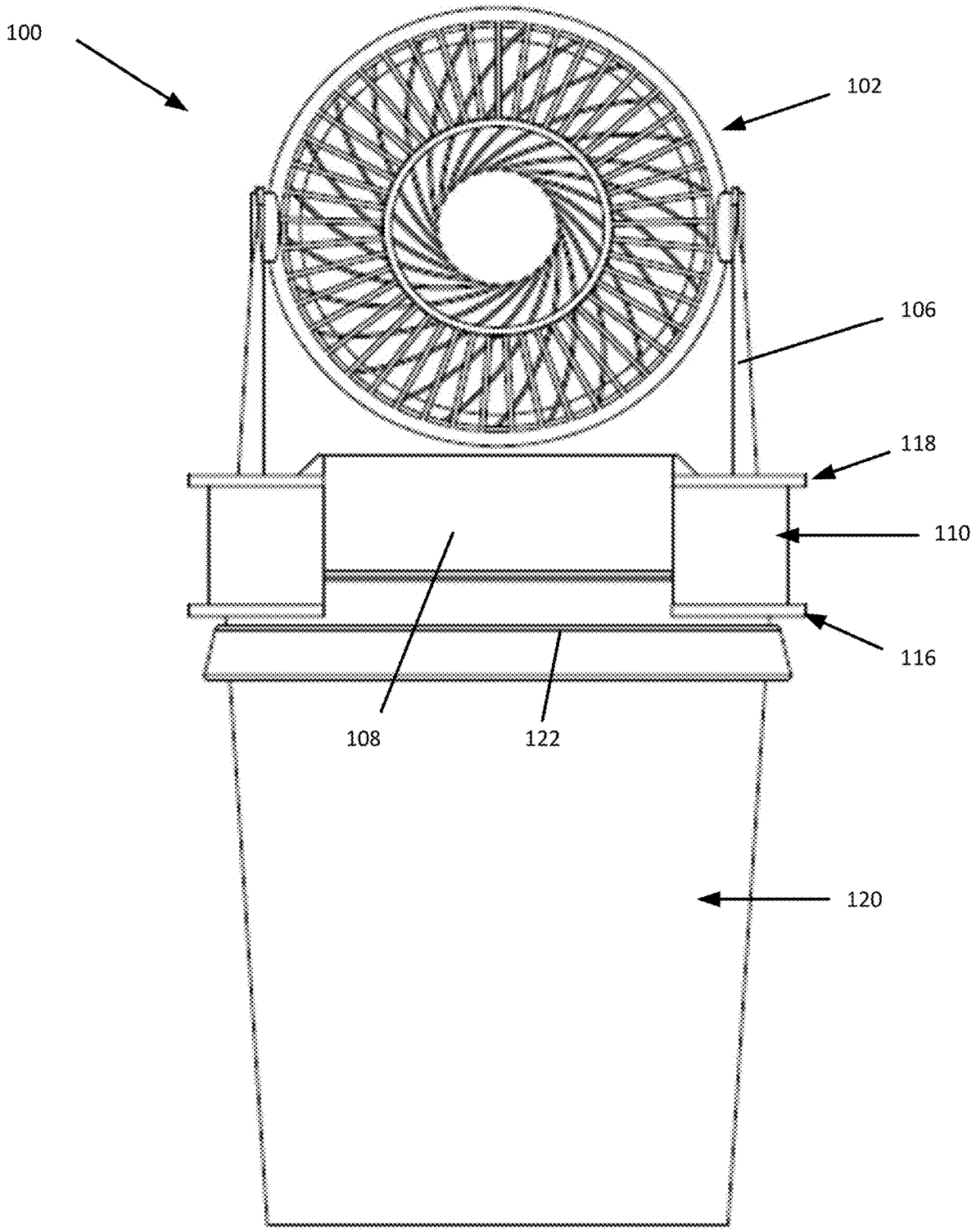
FIG. 5 illustrates a rear view of an embodiment of a portable misting fan in accordance with the teachings and principles of the disclosure.
Figure 6:
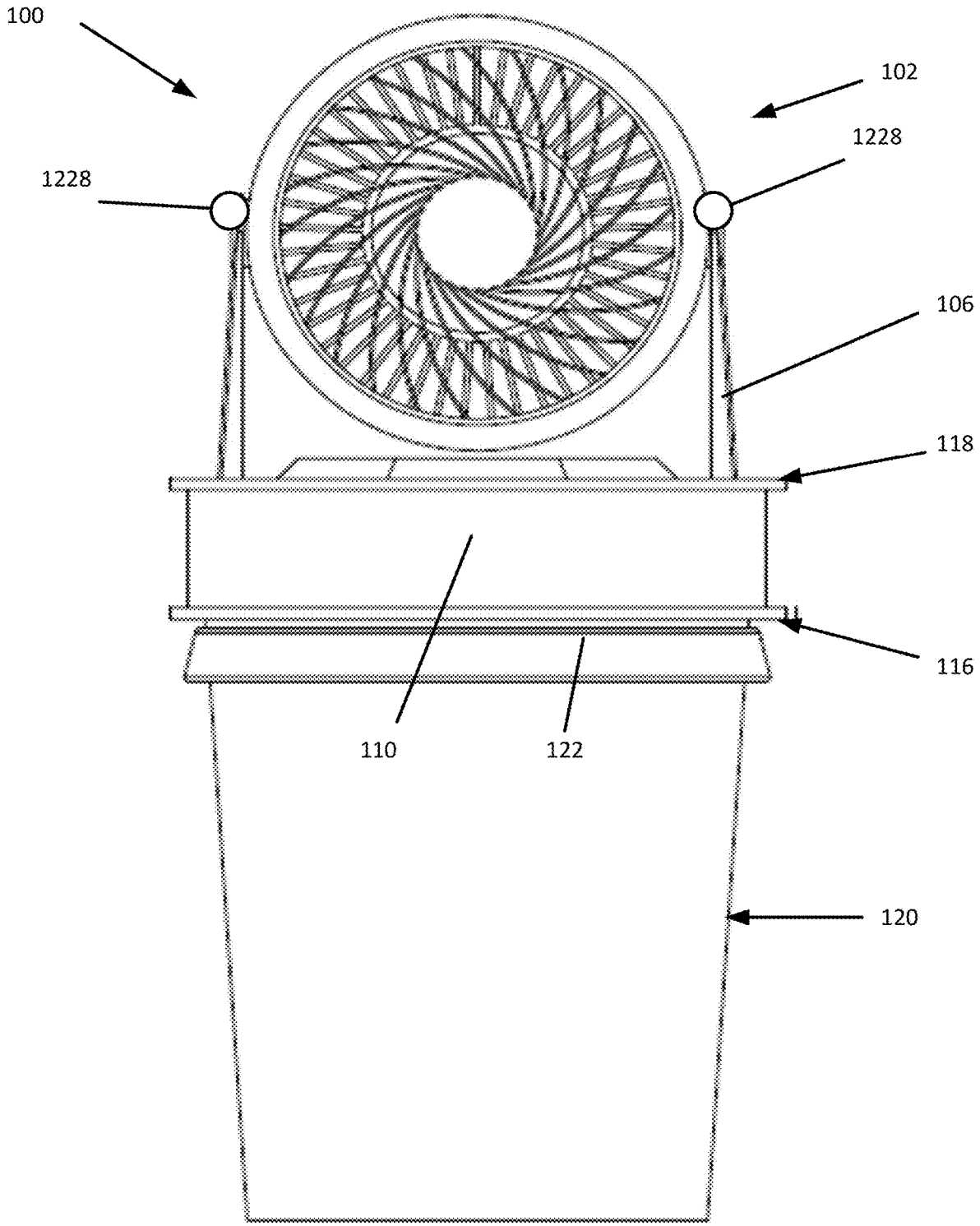
FIG. 6 illustrates a front view of an embodiment of a portable misting fan in accordance with the teachings and principles of the disclosure.
Figure 7:
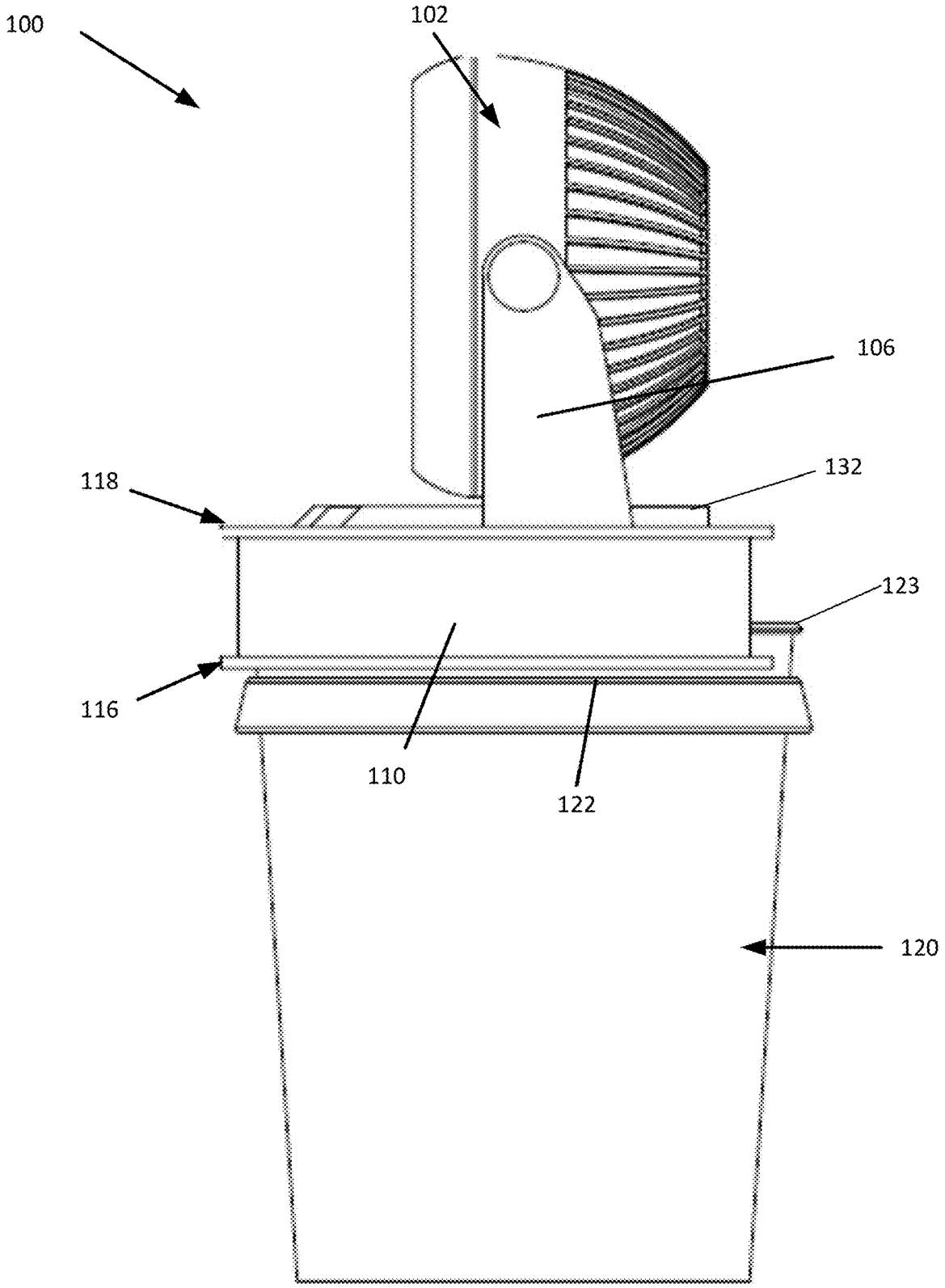
FIG. 7 illustrates a side view of an embodiment of a portable misting fan in accordance with the teachings and principles of the disclosure.

FIGS. 5-7 illustrate various views of a portable misting fan system 100. FIG. 5 illustrates a rear view showing a cutout in the attachment component 110. FIG. 6 illustrates a front where the cutout in the attachment component 110 is not visible. FIG. 7 illustrates a side view. The system 100 include a fan 102 and at least one fan support 106. The system includes an attachment component 110 comprising an upright connection component 116 for connecting the attachment component 110 to the receptacle 120 in an upright configuration where the fan 102 sits atop the receptacle 120. The attachment component 110 includes a storage connection component 118 for connecting the attachment component 110 to the receptacle 120 in a storage configuration where the fan 102 is stored inside the receptacle 120 in an upside-down configuration.

The receptacle 120 includes a flange 122 disposed about an exterior surface of the receptacle 120. The receptacle 120 further includes an upper edge 123 defining a perimeter around the top edge 123 of the receptacle 120. In an embodiment, the upright connection component 116 is configured to sit on the upper edge 123 and provide additional support along the flange 122 of the receptacle in an upright configuration. The storage connection component 118 is configured to sit on the upper edge 123 and provide additional support along the flange 122 of the receptacle in a storage configuration.

Figure 8:
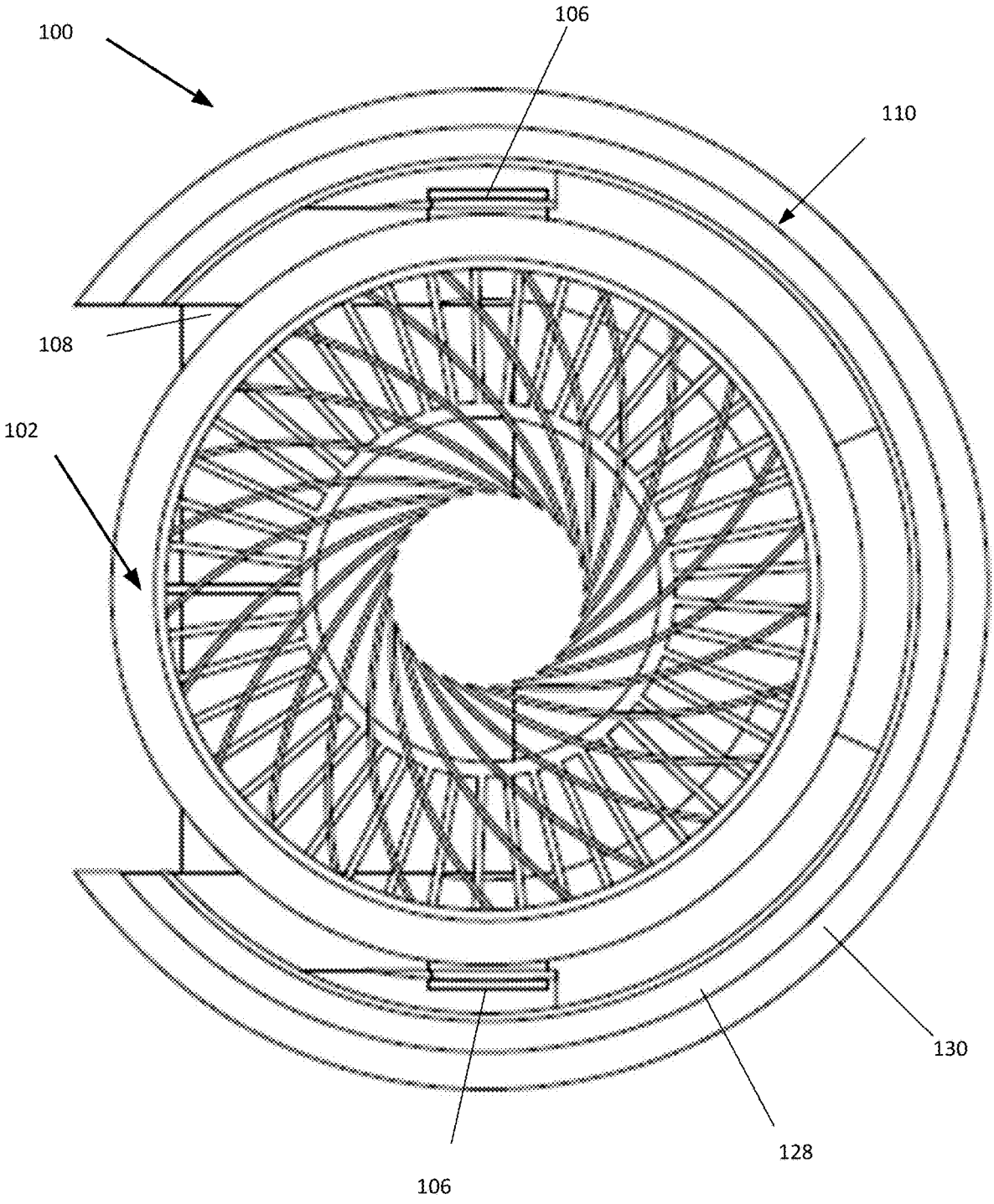
FIG. 8 illustrates an aerial view of an embodiment of a portable misting fan in accordance with the teachings and principles of the disclosure.

FIG. 8 illustrates an aerial view of a portable misting fan system 100 in an active configuration where the fan 102 is located above a receptacle. The system 100 include a fan 102 including at least one fan support 106. The system 100 includes a fan 102 including two fan supports 106. The system 100 includes an attachment component 110 comprising an upright connection component 116 (not shown) and a storage connection component. The storage connection component includes a storage channel 128 and a storage flange 130. The storage channel 128 is configured to rest on an upper ridge of a receptacle in a storage configuration. The storage flange 130 is configured to rest on a flange disposed about an exterior of receptacle in a storage configuration. The system 100 further includes components 108 stored within an interior space of the attachment component 110. The components 108 may include any necessary components such as a battery, a pump, a tubing system, and so forth.

Figure 9:
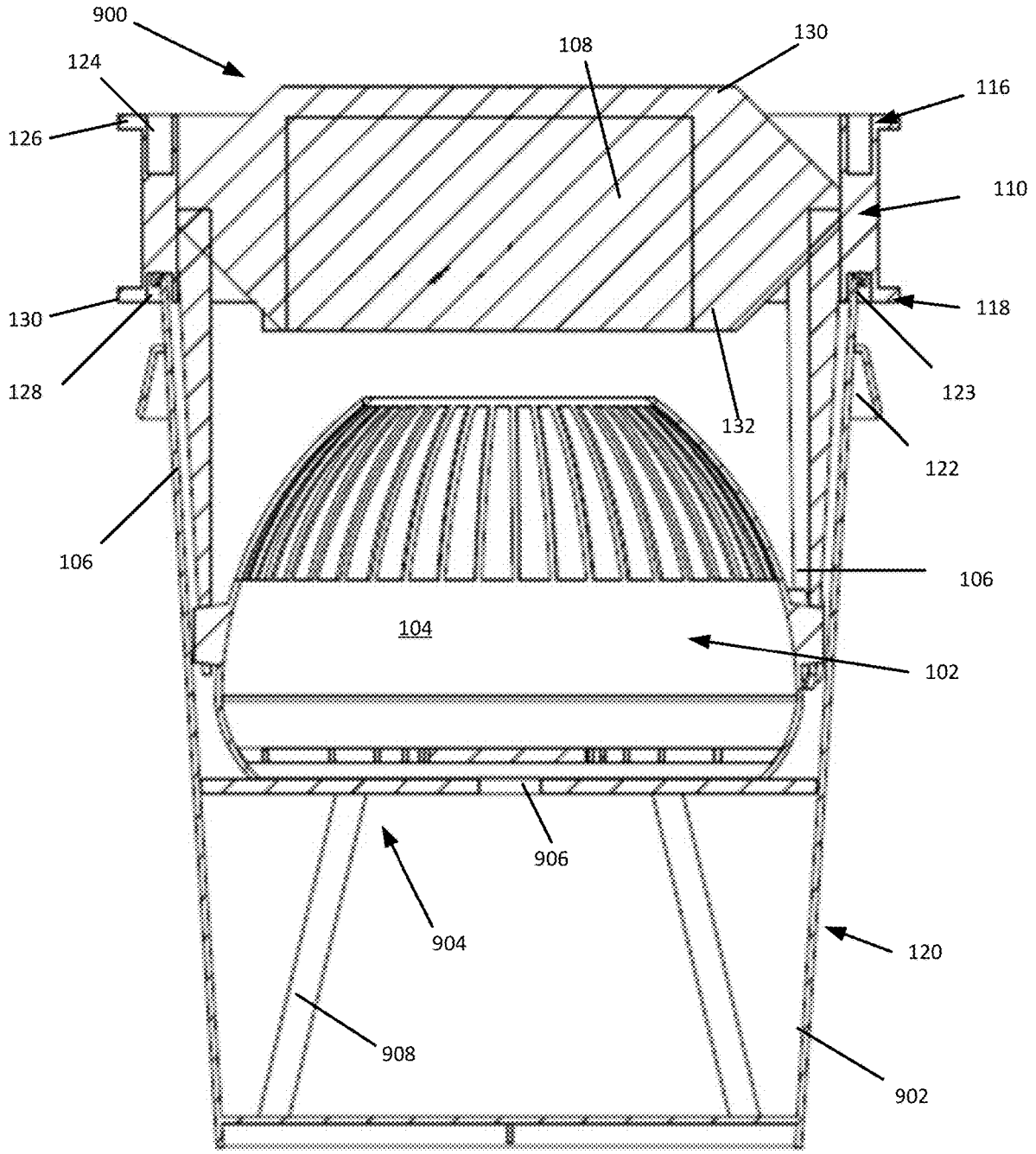
FIG. 9 illustrates a cut-away side view of an embodiment of a portable misting fan in accordance with the teachings and principles of the disclosure.

FIG. 9 illustrates a cut-away side view of a portable fan misting system in a storage configuration 900. The system 900 includes a fan 102 having one or more fan supports 106. The fan support 106 secure the fan 102 to an attachment component 110. The attachment component is configured to connect the fan 102 to a receptacle 120. The attachment component 120 may connect the fan 102 to the receptacle 120 by resting on the receptacle 120 without creating a permanent or fixed attachment.

The attachment component 110 includes an upright connection component 116 and a storage connection component 118. As shown in FIG. 9, the storage connection component 118 is in use when the system 900 is in a storage configuration such that the fan 102 is stored within the receptacle 120. As shown in FIG. 9, the upright connection component 116 is not in use when the system 900 is in a storage configuration. The upright connection component 116 includes a channel 124 and a flange 126. The storage connection component 118 includes a storage channel 128 and a storage flange 130. The storage channel 128 is configured to rest on an upper ridge 123 of a receptacle 120 as shown in FIG. 9. The storage flange 130 may be configured to rest on a flange 122 disposed about an exterior surface of the receptacle 120 in an implementation.

The attachment component 110 includes an interior space defined by a wall 112 (not shown), a base 130, and a lid 132. The interior space may include a plurality of components 108 stored therein. Components may include, for example, a battery, a pump, and so forth. In an embodiment, the interior space is readily accessible by a cutout in the wall such that a user may, for example, replace a battery with ease.

The receptacle 120 includes a wall 902, a flange 122 disposed about an exterior surface of the receptacle 120, and an upper edge 123 at the top of the receptacle 120. In an embodiment, the system 900 includes a fluid stability component 904 configured to control the motion of fluid in the receptacle 120.

The fluid stability component 904 may be desirable if there is some fluid stored in the receptacle and the system is being transported. For example, without a fluid stability component 904, any stored fluid may move irregularly within the receptacle when the system is being transported, and the movement of fluid may cause the system to fall over and spill the fluid or damage system components. The fluid stability component 904 controls the movement of fluid within the receptacle and can prevent such an occurrence. The fluid stability component 904 includes a splashguard 906 that fits within the circumference or inner diameter of the receptacle 120 as defined by the outer wall 902 of the receptacle 120. In an embodiment, the splashguard 906 has an outer diameter that is one inch smaller than the inner diameter defined by the outer wall 902 of the receptacle 120. In an embodiment, the splashguard 906 has a diameter one-half inch smaller than the outer wall 902. In an embodiment, the splashguard 906 has a diameter of 11.5 inches and may be configured to fit within a standard five-gallon bucket having a standard diameter of 12 inches. In an embodiment, the splashguard 906 includes at least one channel or hole configured to permit tubing to pass through the splashguard 906 to make a fluid communication with a pump. The channel or hole is also configured to permit a user to insert a tool or the user's finger to lift or manipulate the splashguard 906 within the receptacle 120, such that the splashguard 906 may be removed from the receptacle 120 with ease. The splashguard 906 may be a vertical wall extending from the top to the base of the fluid receptacle 120. In an embodiment, the splashguard 906 extends for a length from the base to a vertical distance that is about one-third of the fluid receptacle 120. In an embodiment, the splashguard 906 extends only from the base of the fluid receptacle to one-half up the vertical distance of the fluid receptacle 120. In an embodiment, the splashguard 906 is constructed of a rigid material. In an embodiment, the splashguard 906 is constructed of semi-rigid or pliable material such that the splashguard 906 may be rolled, bent, or folded for storage. In an embodiment, the splashguard 906 includes two cross-sections that are attached in the middle and form four equal sections. In an embodiment, the splashguard 906 includes two cross-sections including reciprocal channels, such that the cross-sections can be removably attached to one another.

The fluid stability component 904 includes at least one support 908 configured to support the splashguard 906. In an embodiment, the support 908 is telescoping such that a user may adjust the vertical height of the fluid stability component 904. Such an embodiment may be desirable if a user wishes to lower the fluid stability component 904 when the fan 102 is stored within the fluid receptacle 120, and raise the fluid stability component 904 when the system is in use and the fluid receptacle is full of fluid. In an embodiment, the fluid stability component 904 may be removed from the fluid receptacle 120 when the system is in use and may be placed in the fluid receptacle 120 to prepare the system for transport.

In an embodiment, a user may fill the receptacle 120 up to an appropriate fill line. In an embodiment the fill line exists at the level of the splashguard 906 of the fluid stability component 904. In such an embodiment, the user may fill the receptacle 120 with water up to the splashguard 906, use the storage connection component 118 to suspend the fan 102 inside the receptacle 120, and carry the system 900 to an event or other location. The user may then reverse the configuration of the system such that the upright connection component 116 is in use and the fan 102 is located above the entirety of the receptacle 120. The user may then operate the pump and the fan to have a mist blown on a user via a misting nozzle 1228.

Figure 10:
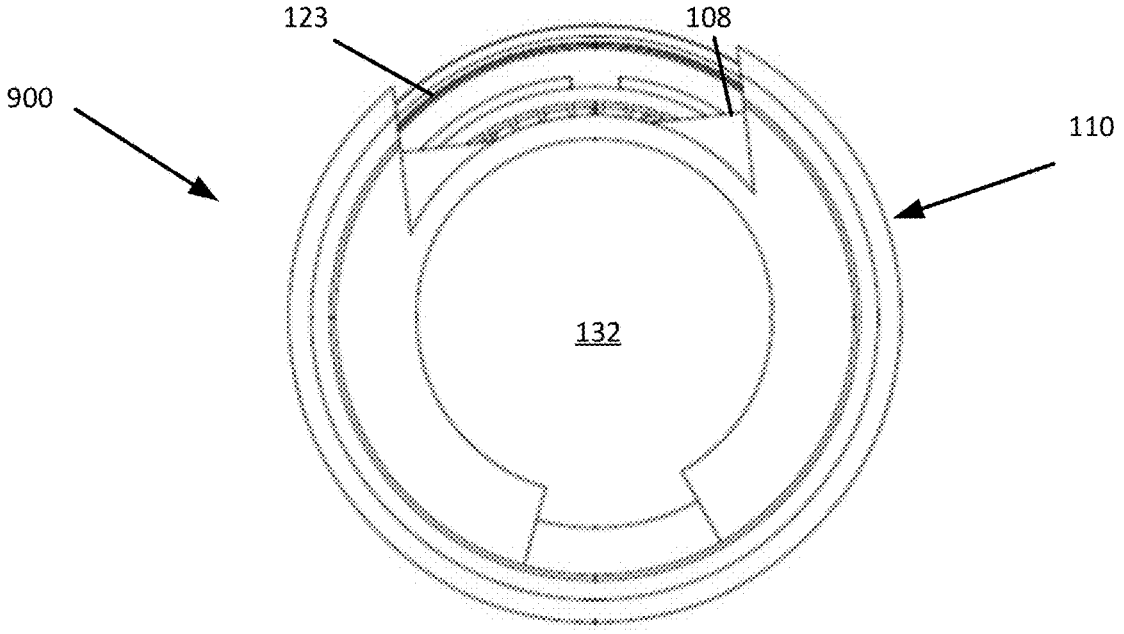
FIG. 10 illustrates an aerial view of an embodiment of a portable misting fan in accordance with the teachings and principles of the disclosure.

FIG. 10 illustrates an aerial view of a portable fan misting system in a storage configuration 900. The system 900 includes an attachment component 110 secured to a fan 102 via a fan support 106. The attachment component may be configured to rest on an upper edge 123 of a receptacle in a storage configuration such that the fan 102 is located within the receptacle. The system 900 includes a plurality of components 108 disposed within an interior space of the attachment component 110.

Figure 11:
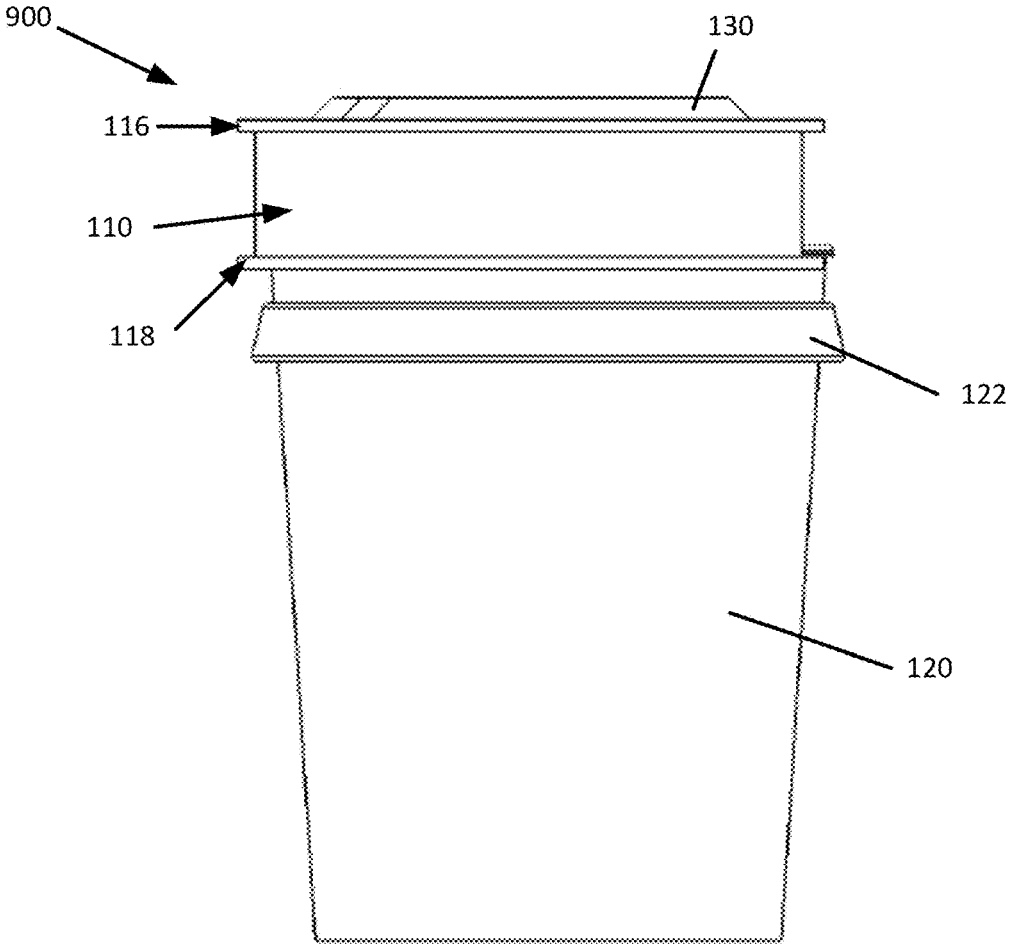
FIG. 11 illustrates a side view of an embodiment of a portable misting fan in accordance with the teachings and principles of the disclosure.

FIG. 11 illustrates a side view of a portable fan misting system in a storage configuration 900. The system 900 includes a fan 102 (not shown) stored inside a receptacle 120. The attachment component 110 includes an upright connection component 116 and a storage connection component 118. As illustrated in FIG. 11, the storage connection component 118 is in use when the system 900 is in a storage configuration such that the fan 102 is stored within the receptacle 120. The attachment component 110 may further include a base 130 that may be located at the top of the system 900 when the system 900 is in the storage configuration.

Figure 12:
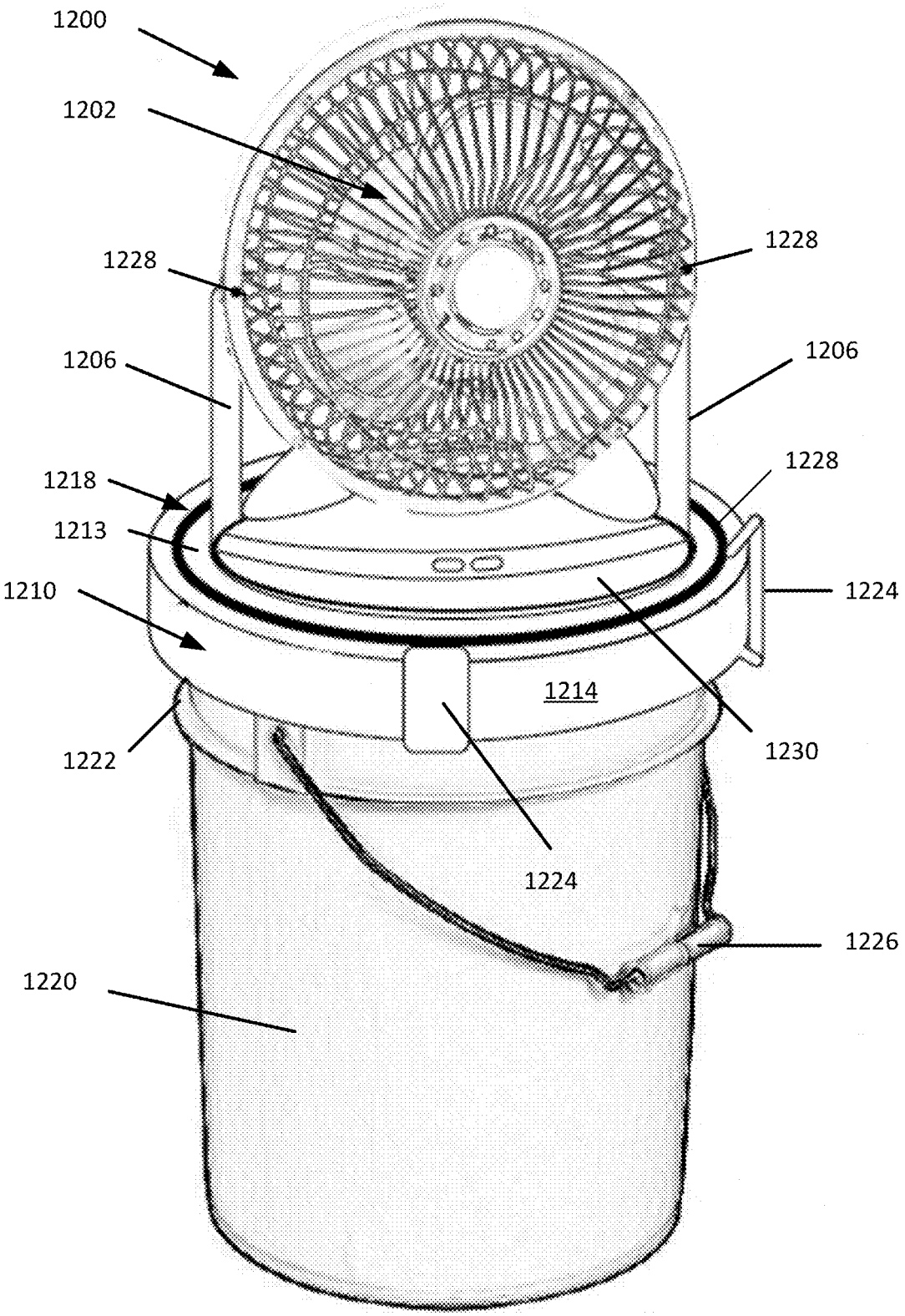
FIG. 12 illustrates a perspective front view of an embodiment of a portable misting fan in accordance with the teachings and principles of the disclosure.
Figure 13:
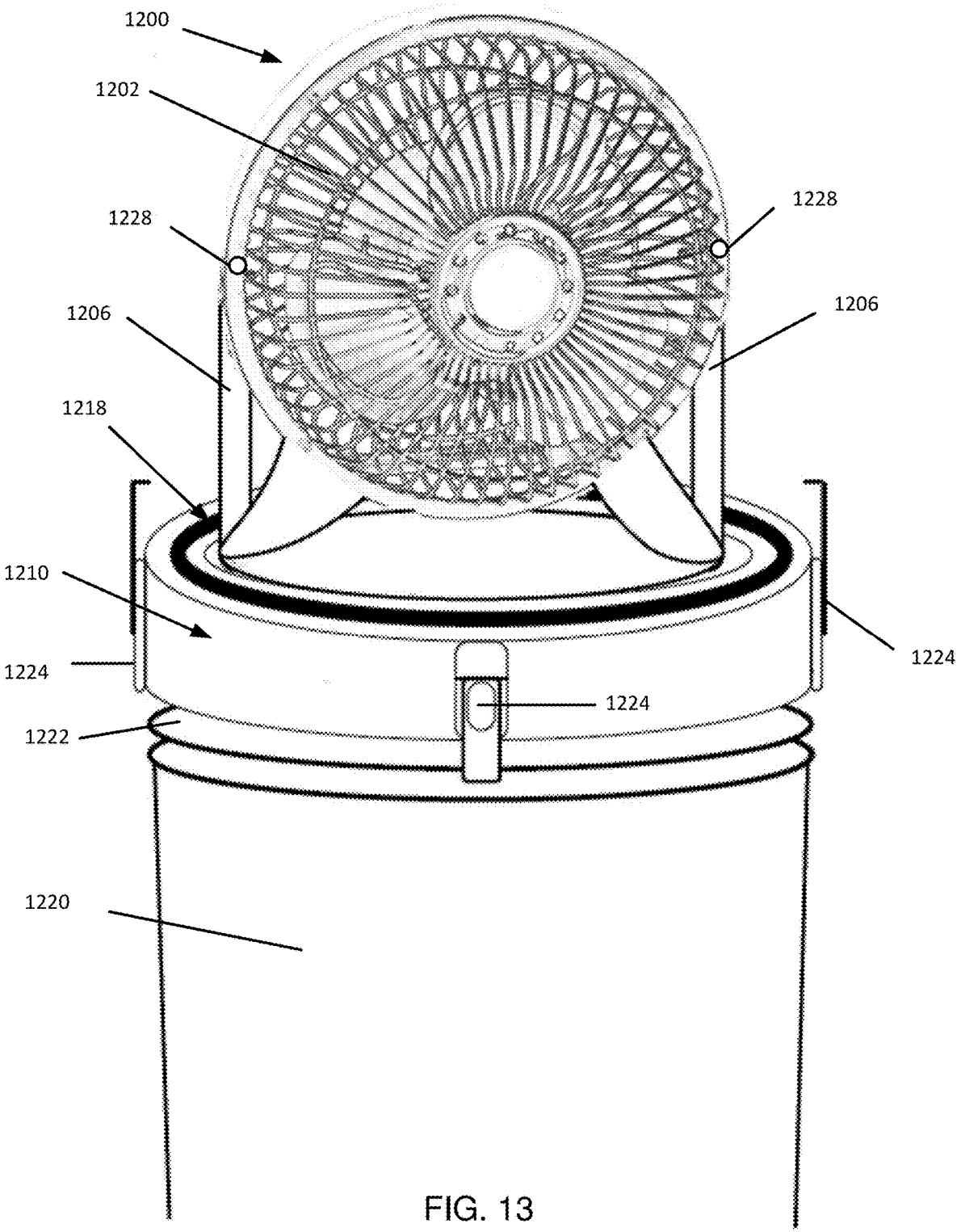
FIG. 13 illustrates a perspective front view of an embodiment of a portable misting fan in accordance with the teachings and principles of the disclosure.

FIG. 12 illustrates a front perspective view of a portable fan misting system 1200. The system 1200 including an attachment component 1210, a receptacle 120, and an attachment component 1210. The attachment component 1210 may be removably attached to the receptacle 1220 with the attachment component 1210.

The attachment component 1210 may include at least one misting nozzle 1228 configured to spray a fluid in a fine mist. The misting nozzle 1228 may be attached to a fan 1202 or it may stand-alone. In an implementation, there are two misting nozzles 1228 1228 attached on opposite sides of a fan 1202, as illustrated in FIG. 12.

The system 1200 includes one or more fan supports 1206 configured to secure the fan 1202 to the attachment component 1210. In an embodiment the fan supports 1206 comprise a substantially flat shape such that the fan 120 and the fan supports 1206 may be stored inside the receptacle 1220 in a storage configuration (not shown). The fan supports 1206 may be substantially flat such that the size of the fan 1202 may be optimized to be as large as possible while still fitting inside the receptacle 1220.

In an embodiment, the fan support 1206 may specifically attach the fan 1202 to an interior surface 1213 of the attachment component 1210. The fan support 1206 may be round or flat and it may be constructed of any suitably rigid material that may support the weight of the fan 1202. The fan support 1206 may include a telescoping feature that may enable a user to manipulate the height or position of the fan 1202 without adjusting the position of the receptacle 1220. The fan support 1206 may be configured to allow the fan to rotate while in use without adjusting the position of the attachment component 1210 or the receptacle 1220. Further, the fan support 1206 may include a hose within the bar that may feed a fluid into the misting nozzle 1228. The fan support 1206 may further hide electrical wiring, a motor, or the like that enables the fan 1202 to rotate while in use.

The attachment component 1210 may also include a fan base 1230. The fan base 1230 may cover the fluid within the receptacle 1220 when the attachment component 1210 is in use. The fan base 1230 may also serve as a flat lid for the system 1200 when the fan 1202 is stored within the receptacle 1220 when the system 1200 is not in use. The fan base 1230 may be constructed of any suitably rigid material that may support the weight of the fan 1202. The attachment component 1210 may include operational components that are hidden and secured by a cover 1230. The operational components may include, for example, a motor for rotating the fan, a pump for pumping water from the receptacle 1220 into the nozzles 1228 that spray into the fan 1202, a battery for operating the system 1200, and associated electrical components.

The misting nozzles 1228 1228 may be attached to the fan 1202 as illustrated in FIG. 12. In an implementation, the system 1200 includes a separate misting nozzle 1228 attached to a hose that may be operated separate from the fan 1202. In an implementation, the system 1200 includes a long hose comprising a plurality of misting nozzles 1228 1228 that may be operated separate from the fan 1202. The misting nozzles 1228 1228 may be configured to spray a mist at one pressure level, or the nozzles may be configured to allow a user to adjust the force or radius of the misting spray. In an embodiment, the system 1200 includes two misting nozzles 1228 1228 wherein a misting nozzle 1228 is attached to the fan support 1206 on either side of the fan 120. In an embodiment, the system 1200 includes a single misting nozzle 1228. It should be appreciated that the misting nozzle 1228 is in fluid communication with the receptacle 1220 or other water source. In an embodiment, a pump is disposed within an interior space of the attachment component 1210 and the pump is configured to draw water out of the receptacle 1220 and push water out of the misting nozzle 1228 at an appropriate pressure.

In an implementation, the fan 1202 is configured to be stored upside down in a storage, non-active configuration within the receptacle 1220 when the system 1200 is in a storage, non-active configuration. In an implementation, the receptacle 1220 is a standard five-gallon bucket and the size and shape of the attachment component 1210 is configured to rest on an upper edge of the five-gallon bucket.

The attachment component 1210 includes a wall comprising an interior surface 1213 and an exterior surface 1214. The attachment component 1210 includes an upright connection component (see 116) and a storage connection component 1218. In an embodiment, at least one of the upright connection component 116 and the storage connection component 1218 includes a channel (see 1228) that may securely receive an upper edge on the receptacle 1220, such that the attachment component 1210 is attached to the receptacle 1220.

In an embodiment, the attachment component 1210 includes two separate channels extending a portion of a height of the attachment component 1210. In an embodiment, the wall of the attachment component 1210 forms a connection at a midpoint in the height of the attachment component and there is a channel existing on either side of the connection. In an embodiment, a first channel may securely receive an upper edge of the receptacle 1220 in an active configuration and a second channel may securely receive an upper edge of the receptacle 1220 in a storage configuration.

As illustrated in FIG. 12, the attachment component 1210 may include a latch 1224 configured to secure the attachment component 1210 to the receptacle 1220. The latch 1224 may be configured to secure the attachment component 1210 to the receptacle 1220 in either of the active configuration or the storage configuration. In an embodiment, the attachment component 1210 includes at least one latch configured to secure the attachment component 1210 to the receptacle 1220 (such as to an outer lip or ring of the fluid receptacle) in the active configuration, and also at least one latch configured to secure the attachment component 1210 in the storage configuration. The latch 1224 may include any suitable latch known in the art, including, for example, a latch bolt, a cabin hook, a crossbar, a spring claw latch, a toggle latch, a swing catch, a small ball clasp, a snap catch, a hasp, or a cabinet latch. Further, the latch may include any suitable device known in the art for securing one object to another, including, for example, a cord or a hook and eye. In an embodiment, the attachment component includes a plurality of latches, wherein each latch is configured to secure the attachment component 1210 to the receptacle 1220 in one of the two configurations.

The receptacle 1220 includes any suitable receptacle for holding a fluid, such as water. The fluid receptacle may include a handle 1226 and at least one flange 1222 disposed about an exterior surface of the receptacle 1220. In an embodiment, the receptacle 1220 is a standard five-gallon plastic bucket. In an embodiment, the receptacle 1220 includes screw threads that may correspond to screw threads in the attachment component 1210. In an embodiment, the handle 1226 may be used to transport the system 1200 when the system is in either of the active configuration or the storage configuration.

Figure 14:
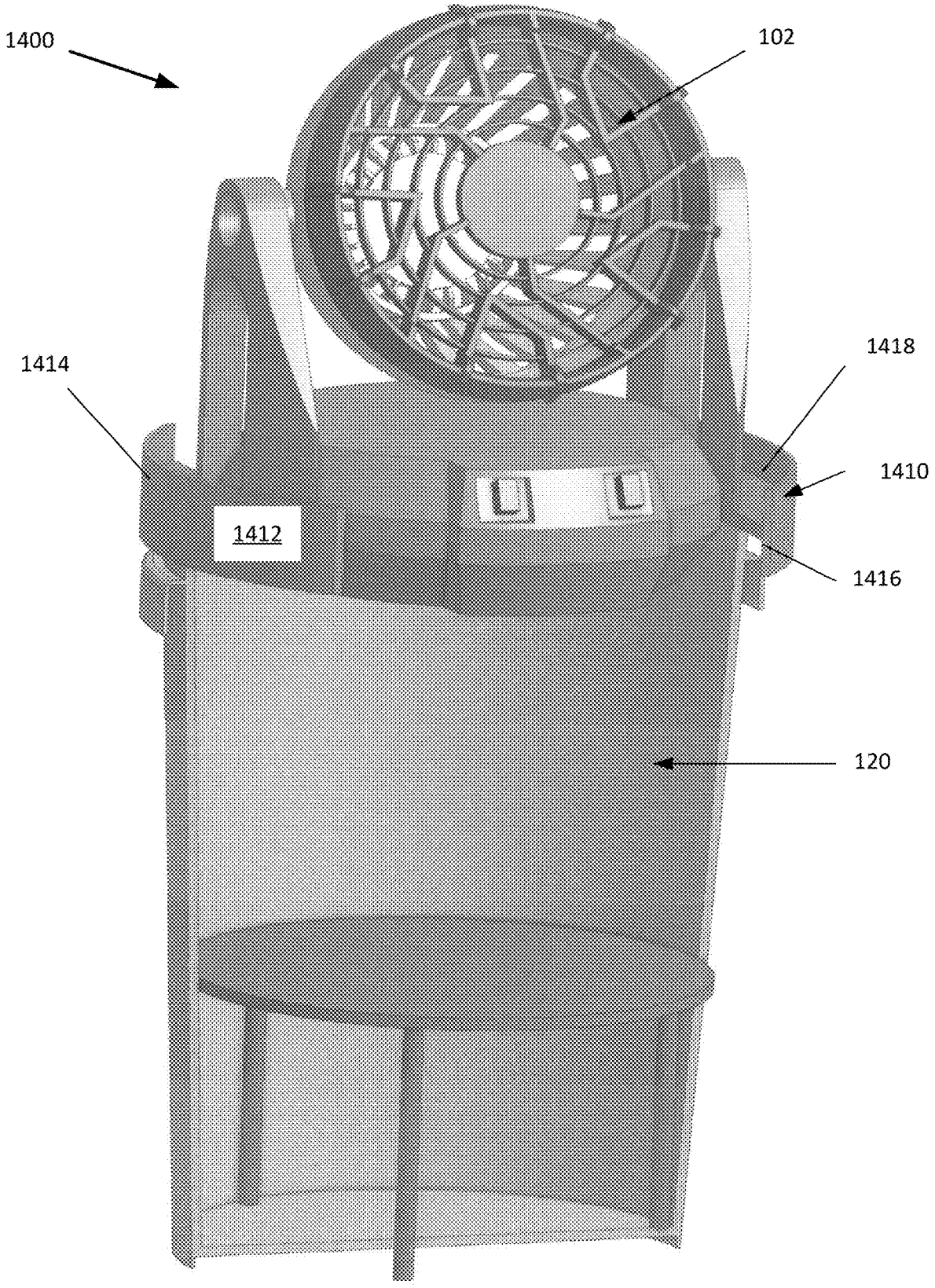
FIG. 14 illustrates a cutout perspective view of an embodiment of a portable misting fan in accordance with the teachings and principles of the disclosure.
Figure 15:
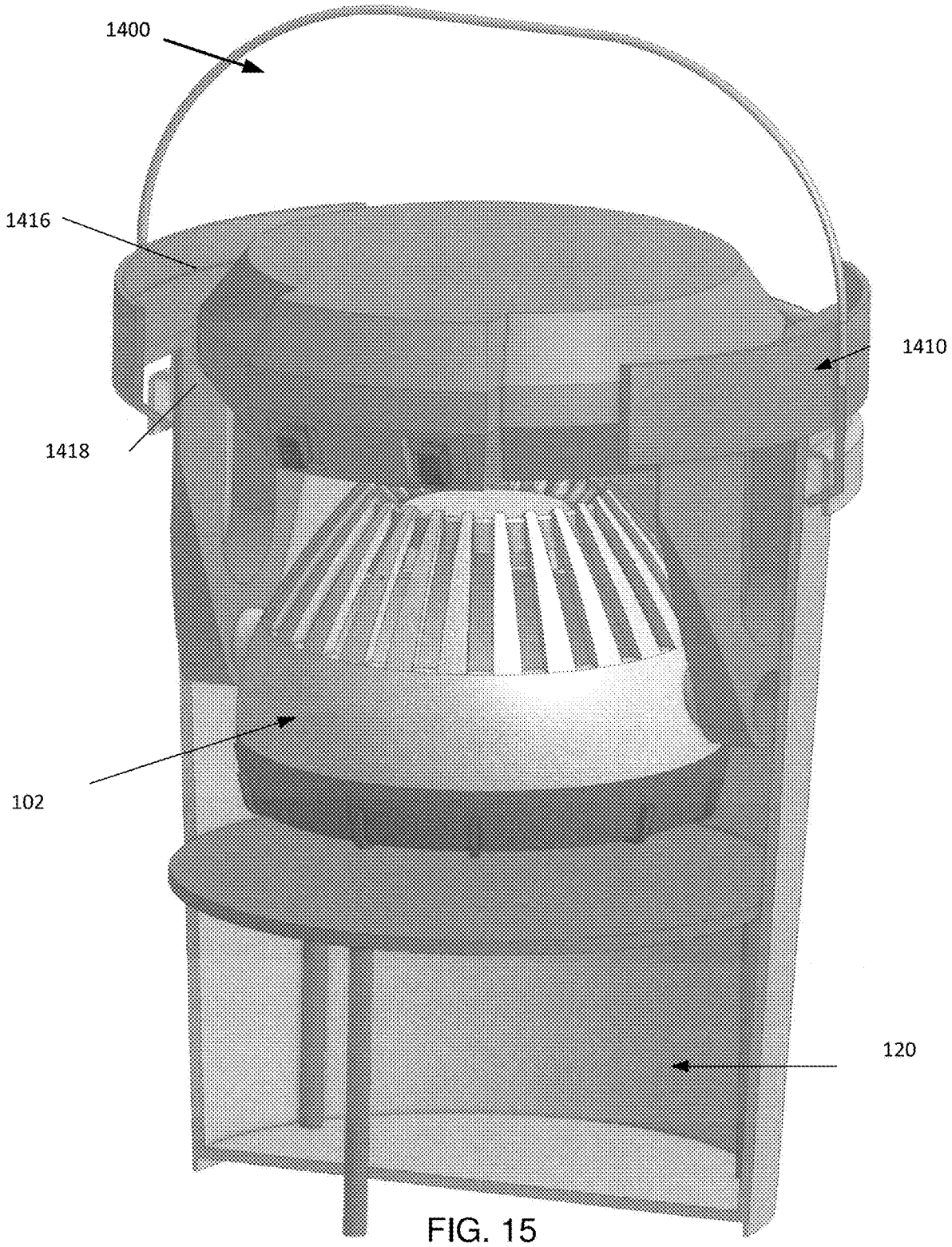
FIG. 15 illustrates a cutout perspective view of an embodiment of a portable misting fan in accordance with the teachings and principles of the disclosure.
Figure 16:
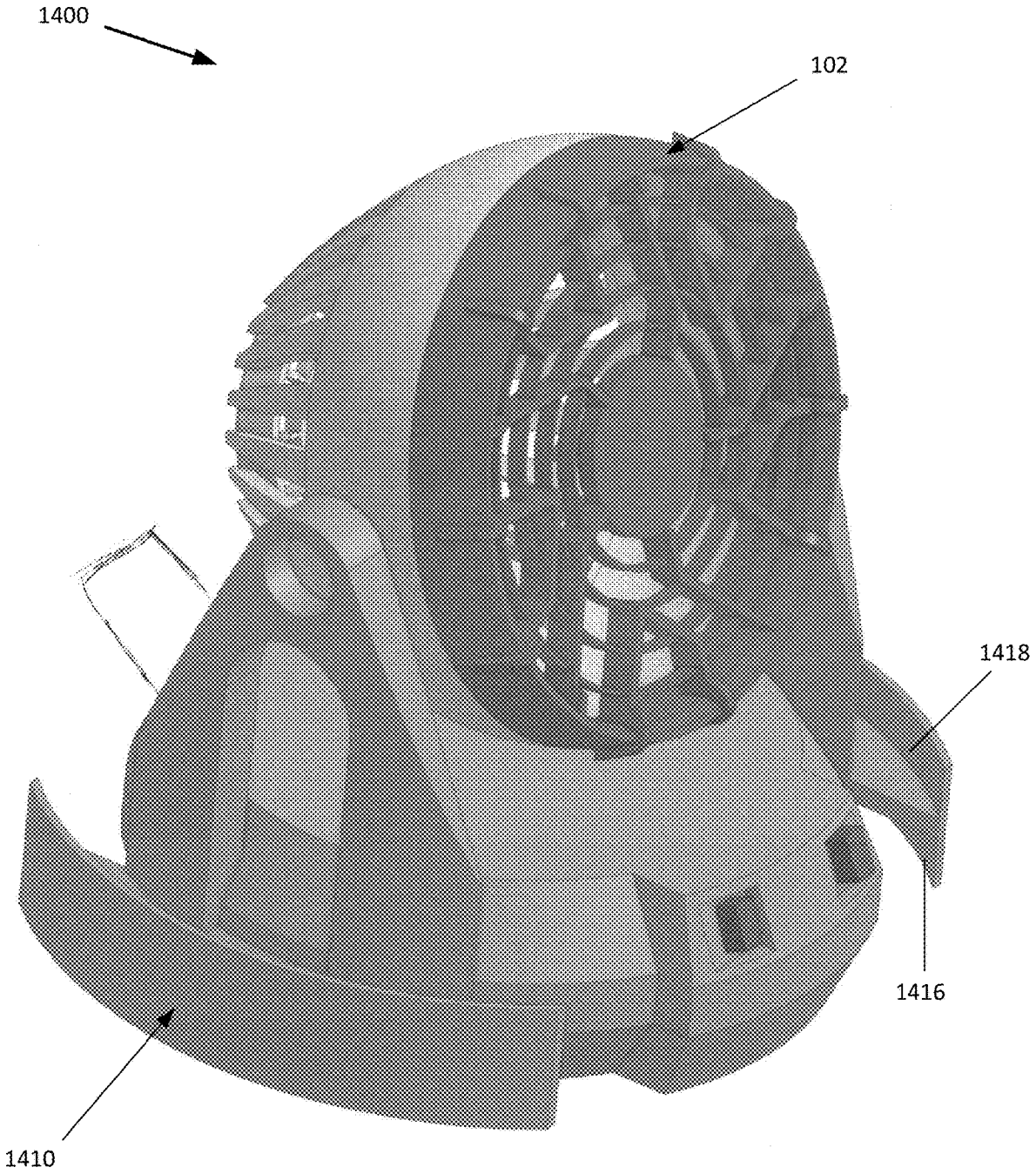
FIG. 16 illustrates perspective view of a fan and attachment component of an embodiment of a portable misting fan in accordance with the teachings and principles of the disclosure.

FIGS. 14-16 illustrate various views of an alternative embodiment of a portable fan misting system 1400 in accordance with the present disclosure. It should be noted that features of the system 1400 disclosed in FIGS. 14-16 may be similar or identical to other embodiments of the disclosure unless specifically mentioned. The system 1400 includes a fan 102 and a receptacle 120 for holding a liquid. The system includes an attachment component 1410 including a first connection component (upright connection component) 1416 and a second connection component (storage connection component) 1418.

In an embodiment as disclosed in FIGS. 14-16, the attachment component 1410 includes two structures, wherein each structure is attached to a fan support 106. Each structure may include an upright connection component 1416 and a storage connection component 1418. In an embodiment as disclosed in FIGS. 14-16, the attachment component 1410 includes a horizontal portion 1414 attached at a midpoint of a vertical portion 1412, creating two regions forming the upright connection component 1416 and the storage connection component 1418. It should be appreciated that the upright connection component 1416 may include a channel defined by the horizontal portion 1414, the vertical portion 1412, and a side of the receptacle 120. It should be appreciated that the storage connection component 1418 may include a channel defined by the horizontal portion 1414, the vertical portion 1412, and a side of the receptacle 120.

It should be appreciated that the systems, methods, and devices disclosed herein include necessary components for operating a fan and a misting system. The system includes, for example, a pump for pumping water from the fluid receptacle and through the misting nozzles 1228 at an appropriate pressure level to provide a fine fluid mist. The system includes a motor for operating the fan blades and operating a rotation mechanism in the fan.

It should be appreciated that the system may be operated by any suitable power source. In an embodiment, the system is operated with a rechargeable battery that may be removably attached. In an embodiment, the system is operated with standard replaceable batteries. In an embodiment, an internal rechargeable battery operates the system. In an embodiment, the system is operated by a constant power source. In an embodiment, the system includes a battery and the capability of being operated by a constant power source.

It should be appreciated that the system may be operated with or without the use of the fan. That is, only the fan without the misting system may be employed. Further, only the misting system without the fan may be employed.

Examples

The following examples pertain to further embodiments:

Example 1 is an apparatus including a fan and an attachment component attached to the fan. The attachment component includes: a wall comprising an interior surface and an exterior surface, an interior space defined by the wall, a first connection component formed as part of the wall for supporting the fan in an upright, active configuration and connecting the fan to a receptacle in the upright, active configuration, and a second connection component formed as part of the wall for supporting the fan in a storage, non-active configuration and connecting the fan to the receptacle, such that the fan is stored within the receptacle in the storage, non-active configuration.

Example 2 is an apparatus as in Example 1. The apparatus further includes a fan support attached to the fan and the attachment component, and a misting nozzle 1228 secured to at least one of the fan or the fan support.

Example 3 is an apparatus as in any of Examples 1-2, further including a pump disposed in the interior space and the pump is in fluid communication with the misting nozzle 1228, wherein the pump is configured to: create a negative pressure to draw in a liquid and create a positive pressure to dispel the liquid through the misting nozzle 1228.

Example 4 is an apparatus as in any of Examples 1-3, further including a tubing in fluid communication with the pump and the misting nozzle 1228, wherein the tubing is configured to receive a liquid from the receptacle.

Example 5 is an apparatus as in any of Examples 1-4, further comprising a battery disposed in the interior space.

Example 6 is an apparatus as in any of Examples 1-5, wherein the wall of the attachment component comprises an elliptical shape.

Example 7 is an apparatus as in any of Examples 1-6, wherein the wall of the attachment component further comprises a first end and a second end opposing the first end, wherein a gap is formed between the first end and the second end of the attachment component such that the wall comprises an incomplete elliptical shape.

Example 8 is an apparatus as in any of Examples 1-7, wherein at least one of the first connection component and the second connection component comprises a channel defined within the wall of the attachment component that is configured to abut an upper edge of the receptacle.

Example 9 is an apparatus as in any of Examples 1-8, wherein at least one of the first connection component and the second connection component comprises a flange configured to abut an opposing flange disposed about an exterior surface of the receptacle.

Example 10 is an apparatus as in any of Examples 1-9, wherein the fan comprises a width that is sufficient to fit within the interior space defined by the wall, thereby allowing the fan to be stored within the receptacle.

Example 11 is a system. The system includes a fan, a receptacle for holding a liquid, and an attachment component. The attachment component includes a wall comprising an interior surface and an exterior surface, a first connection component formed as part of the wall for supporting the fan in an upright, active configuration and connecting the fan to the receptacle, such that the fan is located on top of the receptacle in the upright, active configuration, and a second connection component formed as part of the wall for supporting the fan in a storage, non-active configuration and connecting the fan to the receptacle, such that the fan is stored within the receptacle in the storage, non-active configuration.

Example 12 is a system as in Example 11, wherein at least one of the first connection component and the second connection component comprises a channel defined within the wall of the attachment component that is configured to abut an upper edge of the receptacle.

Example 13 is a system as in any of Examples 11-12, wherein at least one of the first connection component and the second connection component comprises a flange configured to abut an opposing flange disposed about an exterior surface of the receptacle.

Example 14 is a system as in any of Examples 11-13, wherein the attachment component further comprises a latch secured to the exterior surface, the latch configured to secure the attachment component to the receptacle.

Example 15 is a system as in any of Examples 11-14, wherein the fan comprises a width that is sufficient to fit within the interior space defined by the wall, thereby allowing the fan to be stored within the receptacle.

Example 16 is a system as in any of Examples 11-15, wherein the first connection component further comprises a first channel defined within the wall of the attachment component, wherein the first channel comprises two opposing sides each having a first height. The second connection component further comprises a second channel defined within the wall of the attachment component, wherein the second channel comprises two opposing sides each having a second height. And further wherein the first height is greater than the second height such that a greater portion of the attachment component is connected to the receptacle in the upright, active configuration relative to the storage, non-active configuration.

Example 17 is a system as in any of Examples 11-16, further comprising a fluid stability component disposed inside the receptacle.

Example 18 is a system as in any of Examples 11-17, wherein the receptacle comprises a five-gallon bucket.

Example 19 is a system as in any of Examples 11-18, wherein the system further comprises a fan support attached to the fan and a misting nozzle 1228 attached to at least one of the fan or the fan support.

Example 20 is a system as in any of Examples 11-19, further comprising an interior space defined by the wall and a pump disposed in the interior space, wherein the pump is in fluid communication with the misting nozzle 1228 and the pump is configured to: create a negative pressure to draw in the liquid from the receptacle and create a positive pressure to dispel the liquid through the misting nozzle 1228.

Example 21 is a system as in any of Examples 11-20, further comprising a battery located in the interior space, the battery configured to power at least one of the pump and the fan.

Example 22 is a system as in any of Examples 11-21, wherein the attachment component further comprises a base attached to the wall of the attachment component.

Example 23 is a system as in any of Examples 11-22, wherein the receptacle further comprises a handle and the base comprises a tapered shape such that, in the storage, non-active configuration, the handle may move freely over an exterior surface of the base.

The foregoing description has been presented for the purposes of illustration and description. It is not intended to be exhaustive or to limit the disclosure to the precise form disclosed. Many modifications and variations are possible in light of the above teaching. Further, it should be noted that any or all the aforementioned alternate implementations might be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

In the foregoing Detailed Description, various features of the disclosure are grouped together in a single implementation for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus comprising:

a fan; and an attachment component attached to the fan, the attachment component comprising:

a wall comprising an interior surface and an exterior surface;

an interior space defined by the wall;

a first connection component formed as part of the wall for supporting the fan in an upright, active configuration and connecting the fan to a receptacle in the upright, active configuration; and a second connection component formed as part of the wall for supporting the fan in a storage, non-active configuration and connecting the fan to the receptacle, such that the fan is stored within the receptacle in the storage, non-active configuration.

2. The apparatus of claim 1, further comprising a fan support attached to the fan and the attachment component, and a misting nozzle secured to at least one of the fan or the fan support.

3. The apparatus of claim 2, further comprising a pump disposed in the interior space and the pump is in fluid communication with the misting nozzle, wherein the pump is configured to:

create a negative pressure to draw in a liquid; and create a positive pressure to dispel the liquid through the misting nozzle.

4. The apparatus of claim 3, further comprising a tubing in fluid communication with the pump and the misting nozzle, wherein the tubing is configured to receive a liquid from the receptacle.

5. The apparatus of claim 1, further comprising a battery disposed in the interior space.

6. The apparatus of claim 1, wherein the wall of the attachment component comprises an elliptical shape.

7. The apparatus of claim 6, wherein the wall of the attachment component further comprises a first end and a second end opposing the first end, wherein a gap is formed between the first end and the second end of the attachment component such that the wall comprises an incomplete elliptical shape.

8. The apparatus of claim 1, wherein at least one of the first connection component and the second connection component comprises a channel defined within the wall of the attachment component that is configured to abut an upper edge of the receptacle.

9. The apparatus of claim 1, wherein at least one of the first connection component and the second connection component comprises a flange configured to abut an opposing flange disposed about an exterior surface of the receptacle.

10. The apparatus of claim 1, wherein the fan comprises a width that is sufficient to fit within the interior space defined by the wall, thereby allowing the fan to be stored within the receptacle.

11. A system comprising:

a fan;

a receptacle for holding a liquid; and an attachment component attached to the fan, the attachment component comprising:

a wall comprising an interior surface and an exterior surface;

a first connection component formed as part of the wall for supporting the fan in an upright, active configuration and connecting the fan to the receptacle, such that the fan is located on top of the receptacle in the upright, active configuration; and a second connection component formed as part of the wall for supporting the fan in a storage, non-active configuration and connecting the fan to the receptacle, such that the fan is stored within the receptacle in the storage, non-active configuration.

12. The system of claim 11, wherein at least one of the first connection component and the second connection component comprises a channel defined within the wall of the attachment component that is configured to abut an upper edge of the receptacle.

13. The system of claim 11, wherein at least one of the first connection component and the second connection component comprises a flange configured to abut an opposing flange disposed about an exterior surface of the receptacle.

14. The system of claim 11, wherein the attachment component further comprises a latch secured to the exterior surface, the latch configured to secure the attachment component to the receptacle.

15. The system of claim 11, wherein the fan comprises a width that is sufficient to fit within the interior space defined by the wall, thereby allowing the fan to be stored within the receptacle.

16. The system of claim 11, wherein:

the first connection component further comprises a first channel defined within the wall of the attachment component, wherein the first channel comprises two opposing sides each having a first height;

the second connection component further comprises a second channel defined within the wall of the attachment component, wherein the second channel comprises two opposing sides each having a second height; and the first height is greater than the second height such that a greater portion of the attachment component is connected to the receptacle in the upright, active configuration relative to the storage, non-active configuration.

17. The system of claim 11, further comprising a fluid stability component disposed inside the receptacle.

18. The system of claim 11, wherein the receptacle comprises a five-gallon bucket.

19. The system of claim 11, wherein the system further comprises a fan support attached to the fan and a misting nozzle attached to at least one of the fan or the fan support.

20. The system of claim 19, further comprising an interior space defined by the wall and a pump disposed in the interior space, wherein the pump is in fluid communication with the misting nozzle and the pump is configured to:

create a negative pressure to draw in the liquid from the receptacle; and create a positive pressure to dispel the liquid through the misting nozzle.

21. The system of claim 20, further comprising a battery located in the interior space, the battery configured to power at least one of the pump and the fan.

22. The system of claim 11, wherein the attachment component further comprises a base attached to the wall of the attachment component.

23. The system of claim 22, wherein the receptacle further comprises a handle and the base comprises a tapered shape such that, in the storage, non-active configuration, the handle may move freely over an exterior surface of the base.

* * * * *